US006742778B2

(12) United States Patent
Ferus

(10) Patent No.: US 6,742,778 B2
(45) Date of Patent: Jun. 1, 2004

(54) SIGNATURE HOPPER LOADER

(75) Inventor: Jon M. Ferus, Colgate, WI (US)

(73) Assignee: Quad/Graphics, Inc., Sussex, WI (US)

( * ) Notice: Subject to any disclaimer, the term of this patent is extended or adjusted under 35 U.S.C. 154(b) by 110 days.

(21) Appl. No.: 10/100,255

(22) Filed: Mar. 18, 2002

(65) Prior Publication Data

US 2003/0173733 A1 Sep. 18, 2003

(51) Int. Cl.[7] ..... B65H 85/00
(52) U.S. Cl. ..... 271/3.01; 271/3.14; 271/188
(58) Field of Search ..... 271/3.01, 3.03, 271/3.05, 3.08, 3.14, 188

(56) References Cited

U.S. PATENT DOCUMENTS

| | | | | |
|---|---|---|---|---|
| 2,413,358 A | | 12/1946 | Kleineberg | |
| 3,422,947 A | | 1/1969 | Kraft et al. | |
| 3,674,258 A | * | 7/1972 | Maier et al. | 271/202 |
| 3,741,413 A | | 6/1973 | Friel | |
| 3,904,191 A | | 9/1975 | Maier, Jr. et al. | |
| 3,945,633 A | | 3/1976 | Knopp | |
| 3,945,635 A | | 3/1976 | Marin | |
| 4,008,890 A | | 2/1977 | Pulda | |
| 4,049,260 A | | 9/1977 | Szymborski | |
| 4,183,517 A | | 1/1980 | Hageman et al. | |
| 4,396,112 A | | 8/1983 | von Wietersheim et al. | |
| 4,436,297 A | | 3/1984 | Chandhoke | |
| 4,451,967 A | | 6/1984 | Stobb | |
| 4,518,079 A | | 5/1985 | Paelke | |
| 4,565,285 A | | 1/1986 | Koistinen | |
| 4,577,852 A | * | 3/1986 | Grunder | 271/188 |
| 4,588,180 A | | 5/1986 | Ballestrazzi et al. | |
| 4,747,592 A | | 5/1988 | Pessina et al. | |
| 4,768,770 A | | 9/1988 | Pessina et al. | |
| 4,861,014 A | | 8/1989 | Martin | |
| 4,869,486 A | | 9/1989 | Scarpa et al. | |
| 4,973,038 A | | 11/1990 | Curley et al. | |
| 5,026,038 A | | 6/1991 | Weller et al. | |
| 5,027,940 A | | 7/1991 | Woodward | |
| 5,131,531 A | | 7/1992 | Chambers | |

(List continued on next page.)

FOREIGN PATENT DOCUMENTS

| | | |
|---|---|---|
| DE | 2 404 627 | 5/1975 |
| GB | 2 135 978 | 9/1984 |

*Primary Examiner*—Donald P. Walsh
*Assistant Examiner*—Kaitlin Joerger
(74) *Attorney, Agent, or Firm*—Michael Best & Fridrich LLP

(57) ABSTRACT

The invention provides for an improved signature hopper loader for feeding signatures to a hopper on a binding line. The hopper loader includes two conveyor assemblies that work together to feed signatures to the hopper. The first conveyor assembly is connected to the second conveyor assembly such that there is an angle in the range of 110–120 degrees between the first and second conveyor assemblies. The first and second conveyor assemblies also include forming guides that serve to fan, or deblock, the signatures that are traveling along the first or second conveyor assembly. As the signatures travel over the forming guides, they are bent to give the signatures rigidity and to further facilitate deblocking. The hopper loader further includes an opposing belt that is held on top of at least a portion of one of the transporting belts. The opposing belt is hinged to the frame of the hopper loader and preferably swings down on top of the center belt in the second conveyor. The hopper loader includes a pocket that is connected to the end of the second conveyor assembly. The pocket includes a feed rack that is substantially perpendicular to the end of the second conveyor such that the individual signatures are perpendicular to the feed rack as they leave the end of the second conveyor and enter the pocket. The pocket on the hopper loader of the present invention may also be positioned such that there is a "drop" between the end of the second conveyor and the feed rack.

41 Claims, 7 Drawing Sheets

U.S. PATENT DOCUMENTS

| | | | |
|---|---|---|---|
| 5,161,792 | A | 11/1992 | Wood |
| 5,197,590 | A | 3/1993 | Prim et al. |
| 5,213,321 | A | 5/1993 | Stobb |
| 5,238,239 | A | 8/1993 | LaChapelle |
| 5,246,102 | A | 9/1993 | Rappen et al. |
| 5,249,788 | A | 10/1993 | Helmstadter |
| 5,282,613 | A | 2/1994 | Standerfer et al. |
| 5,360,102 | A | 11/1994 | Schoning |
| 5,374,050 | A | 12/1994 | Prim |
| 5,380,148 | A | 1/1995 | Bates et al. |
| 5,394,979 | A | 3/1995 | Hall et al. |
| 6,017,028 | A | 1/2000 | St. John et al. |
| 6,017,029 | A | 1/2000 | Bates et al. |
| 6,036,186 | A | 3/2000 | Glanzmann et al. |

* cited by examiner

SIGNATURE HOPPER LOADER

FIELD OF THE INVENTION

The invention relates to feeding signatures to a hopper on a binding line, and more particularly to a signature hopper loader and method that delivers signatures to a hopper on a binding line.

BACKGROUND OF THE INVENTION

A typical binding operation utilizes multiple hoppers or packer boxes that are each adapted to receive a supply of signatures from a source of signatures. The hoppers incrementally deliver individual signatures onto a binding line where complete books of signatures are assembled and carried onto another location for further processing to complete the binding process.

Signature hopper loaders are typically used to supply the signatures to the hopper. The advantages of automatically supplying signatures to the hopper instead of manually loading signatures into the hoppers are well known. A typical signature hopper loader receives a log of signatures at an entry end and delivers a supply of signatures to the hopper positioned at an exit end.

SUMMARY OF THE INVENTION

The invention provides for an improved signature hopper loader for feeding signatures to a hopper on a binding line. The hopper loader includes two conveyor assemblies that work together to feed signatures to the hopper. The first conveyor assembly is connected to the second conveyor assembly such that there is an angle in the range of 110–120 degrees between the first and second conveyor assemblies. An angle in the range of 110–120 degrees between the first and second conveyor assemblies facilitates reliably transferring signatures from the first conveyor assembly to the second conveyor assembly.

The first and second conveyor assemblies also include forming guides that serve to fan, or deblock, the signatures that are traveling along the first or second conveyor assembly. As the signatures travel over the forming guides, they are bent to give the signatures rigidity and to further facilitate deblocking. Increasing the rigidity of the signatures facilitates loading the signatures onto the feed rack, especially when compared to signatures that have not been bent where the individual signatures typically "flop around" resulting in increased misfeeds and paperjams. Deblocking the signatures while they are traveling in a shingled stream also enhances the reliability associated with supplying individual signatures to the hopper instead of multiple signatures at one time. Supplying individual signatures to the hopper in turn promotes feeding individual signatures from the hopper onto the binding line thereby minimizing double feeds, no feeds and misfeeds.

In one form, the second conveyor assembly includes a plurality of belts that transport signatures from the first conveyor assembly to the hopper. The hopper loader further includes an opposing belt that is held on top of at least a portion of one of the transporting belts. The opposing belt is hinged to the frame of the hopper loader and preferably swings down on top of the center belt in the second conveyor. The opposing belt is held against the second conveyor by gravity and it can be rotated out of the way when it is not being used. The combination of the opposing belt and the second conveyor moves the signatures into the hopper in a consistent manner.

In another form the hopper loader includes a pocket that is connected to the end of the second conveyor assembly. The pocket includes a feed rack that is substantially perpendicular to the end of the second conveyor such that the individual signatures are perpendicular to the feed rack as they leave the end of the second conveyor and enter the pocket. Since the second conveyor is perpendicular to the feed rack, the signatures are placed onto the feed rack without any substantial change in orientation (i.e. the signatures have the same orientation on the feed rack within the pocket as they do on the second conveyor). Maintaining the orientation of the signatures as they are placed onto the feed rack inhibits the signatures from pushing against previously loaded signatures already on the feed rack and causing misalignment of the previously loaded signatures.

The pocket on the hopper loader of the present invention is preferably positioned such that there is a "drop" between the end of the second conveyor and the feed rack. Once a signature is transported out from the second conveyor assembly, the signature falls downward onto the feed rack. The impact generated by dropping the signature from the second conveyor onto the feed rack ensures that the bottom of the signatures are positioned squarely against the feed rack. Positioning the signatures squarely against the feed rack enhances the reliability associated with supplying individual signatures accurately onto the binding line.

The present invention also relates to a method for feeding signatures to a hopper on a binding line. The method includes supporting signatures on a first conveyor assembly; feeding the signatures on the first conveyor assembly toward the hopper along the travel path; transferring the signatures to a second conveyor assembly; moving the signatures on the second conveyor assembly toward the hopper along the travel path; and dropping the signatures off an end of the second conveyor assembly onto a feed rack that is positioned below the travel path at the end of the second conveyor assembly such that the signatures fall downward onto the feed rack generating an impact which serves to position the signatures squarely against the feed rack.

In another form the method includes transferring the signatures off an end of the second conveyor assembly onto a feed rack such that the signatures are placed onto the feed rack without any substantial change in orientation.

Other features and advantages of the invention will become apparent to those of ordinary skill in the art upon review of the following detailed description, claims and drawings.

Figure 1:
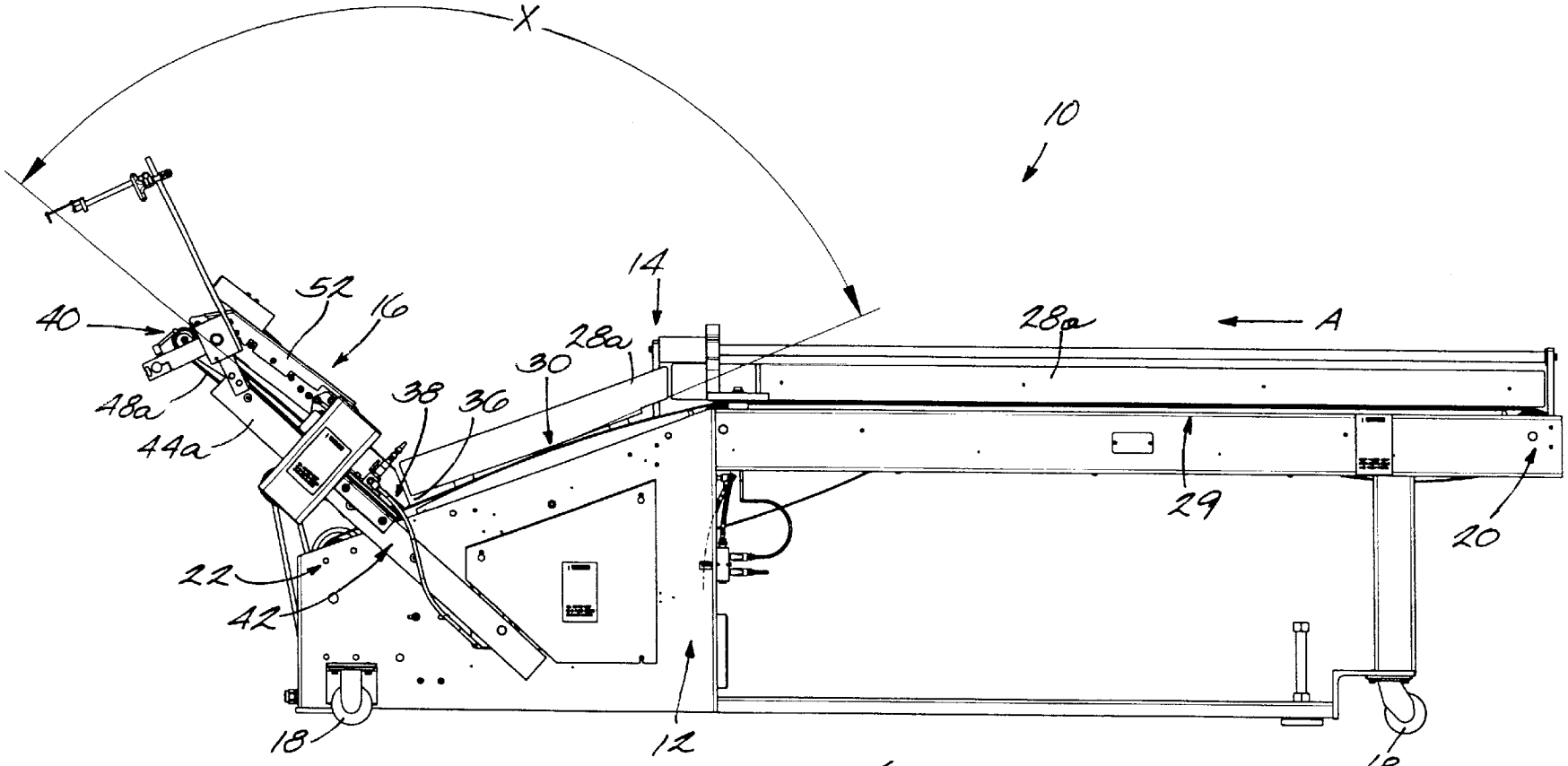
FIG. 1 is a side elevation view of a signature hopper loader embodying the present invention.

Before one embodiment of the invention is to be explained in detail, it is to be understood that the invention is not limited in its application to the details of construction and the arrangements or the components set forth in the following description or illustrated in the drawings. The invention is capable of other embodiments and of being practiced or being carried out in various ways. Also, it is understood that the phraseology and terminology used herein is for purpose of description and should not be regarded as limiting. The use of "including" and "comprising" and variations thereof herein is meant to encompass the items listed thereafter and equivalence thereof as well as additional items. The use of letters to identify elements of a method or process is simply for identification and is not meant to indicate that the elements should be performed in a particular order.

DETAILED DESCRIPTION

FIGS. 1–6 illustrate a signature hopper loader 10 embodying the present invention. The loader 10 generally includes a housing 12, a first conveyor assembly 14 and a second conveyor assembly 16. The housing 12 is preferably on castors 18 that engage the floor or a support surface to make the loader portable for movement as needed to a desired position with respect to a binding line (not shown). The first conveyor assembly 14 includes a first end 20, a second end 22 and a support plate 26 (FIG. 1). The first conveyor assembly 14 also includes a pair of signature guides 28*a–b* that are positioned adjacent to the lateral edges of the support plate 26. At least one of the signature guides 28*a–b* is laterally adjustable so that the hopper loader 10 is able to accommodate different sizes of signatures between the guides 28*a–b*. The first conveyor assembly 14 includes a first conveyor that is preferably made up of two endless chains 34*a–b* which move signatures in the direction of the arrow A in FIG. 1. The chains 34*a–b* are preferably segmented flight conveyor chains that are metal sprayed to obtain a rough top finish which provides the necessary friction between signatures and the conveyor to move the signatures along the conveyor without slipping. The chains 34*a–b* are transported around rollers that are rotatably mounted on shafts. One of the shafts is a drive shaft that moves the chains 34*a–b* in an endless path. It should be noted that any conventional conveyor chain could be used in the first conveyor without departing from the scope of the present invention.

The chains 34*a–b* are adapted to receive and support a log of signatures (not shown) at the first end 20 of the first conveyor assembly 14 and to move the signatures toward the second end 22. The support plate 26 includes an elongated horizontal entry portion 29 and an arched decline portion 30. The elongated horizontal entry portion extends from the first end 20 of the second conveyor assembly and the arched decline portion 30 extends from the second end 22 until the arched decline portion 30 mates with the elongated horizontal entry portion 29. A conveyor extension (not shown) can be mounted adjacent to the first end 20 of the first conveyor assembly 14 so that the hopper loader 10 is able to accommodate a greater number of signatures.

A second conveyor assembly 16 is mounted to the housing 12 and the first conveyor assembly 14. The first and second conveyor assemblies 14, 16 intersect at a transition point 36 (FIG. 1) where the signatures are transferred from the first conveyor assembly 14 to the second conveyor assembly 16.

The second conveyor assembly 16 is preferably inclined and planar and includes a first end 38 and a second end 40. The second conveyor assembly 16 further includes a frame 42 that is made up of lateral supports 44*a–b* and a support plate 46 extending between the lateral supports 44*a–b*. The second conveyor assembly 16 also includes three belts 48*a–c*. The belts 48*a–c* travel in an endless path between the first end 38 of the second conveyor assembly 16 and the second end 40 of the second conveyor assembly 16. The belts 48*a–c* are preferably made of a material such as stranded polyester and are supported by rollers that are mounted on shafts. One of the shafts is connected to a drive which drives the belts 48*a–c* at a speed that is preferably faster than the speed at which the belts 34*a–b* are being driven so that the signatures are maneuvered into a shingled stream as they are transferred from the first conveyor assembly 14 to the second conveyor assembly 16. The belts 48*a–c* on the second conveyor assembly 16 may be driven by an independent drive or a drive common with the belts 34*a–b* of the first conveyor assembly 14. It should also be noted that different numbers and types of belts or conveyors could be used without departing from the scope of the present invention.

The hopper loader 10 also preferably includes one or more sensors that are mounted at various positions on the hopper loader 10 in order to determine the relative quantity and/or alignment of the signatures as the signatures travel along the first and second conveyor assemblies 14, 16. The sensors are in operable communication with the drive(s) of the first and/or second conveyor assemblies to facilitate maintaining an appropriate number of signatures at each location on the hopper loader 10.

The surfaces of the belts 34*a–b* and the belts 48*a–c* that engage the signatures as the signatures move along the hopper loader 10 define a travel path of the signatures. There is an angle X (FIG. 1) between the travel path at the second end 22 of the first conveyor assembly 14 and the travel path at the first end 38 of the second conveyor assembly 16. The angle is preferably in a range between 110–120 degrees, and even more preferably, in a range between 114–116 degrees. This range of angles X between the travel paths on the first and second conveyor assemblies 14, 16 facilitates transferring the signatures from the first conveyor assembly 14 to the second conveyor assembly 16 without bunching at the transition point 36.

Figure 2:
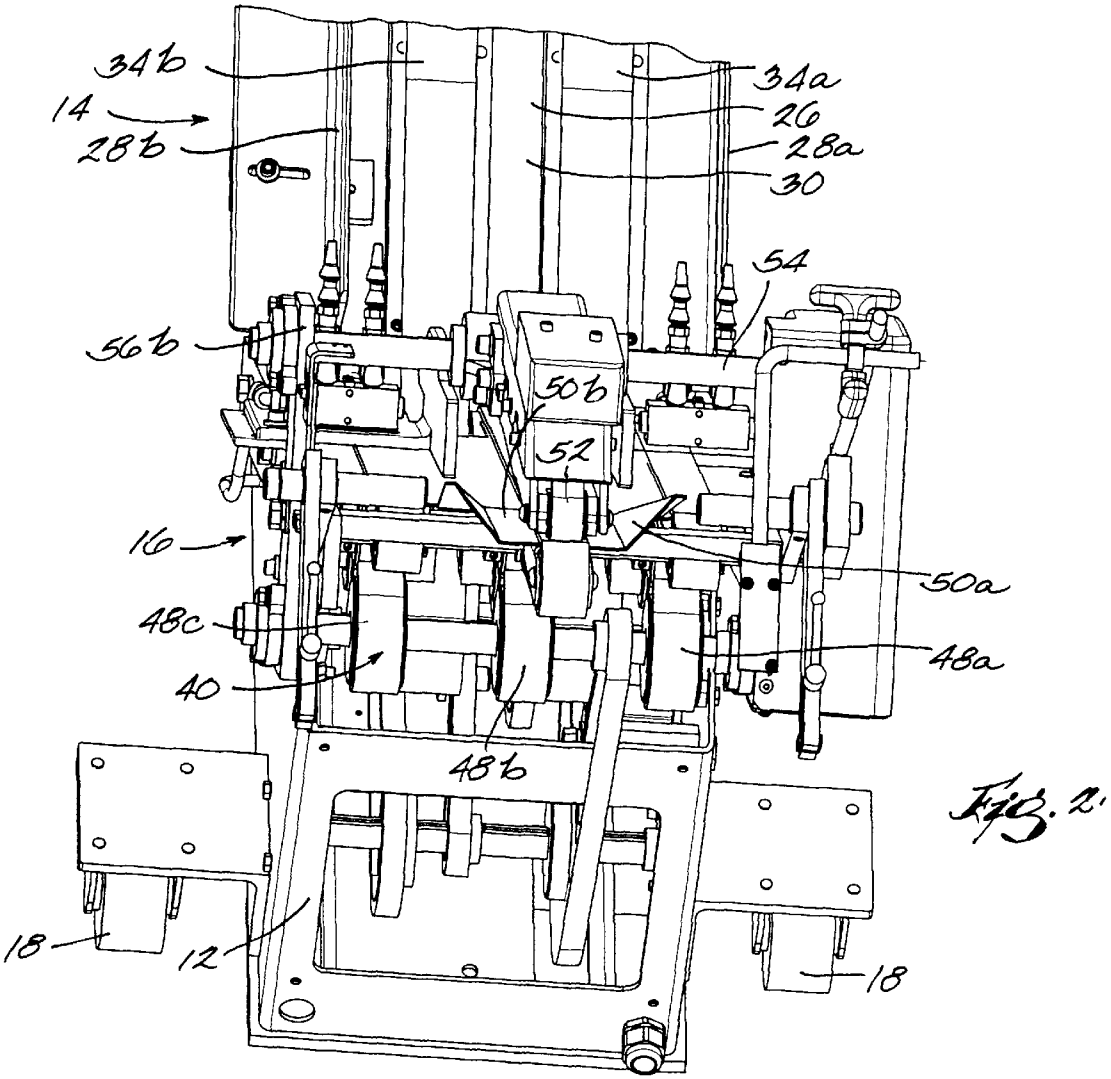
FIG. 2 a perspective view from an end of the signature hopper of FIG. 1.
Figure 3:
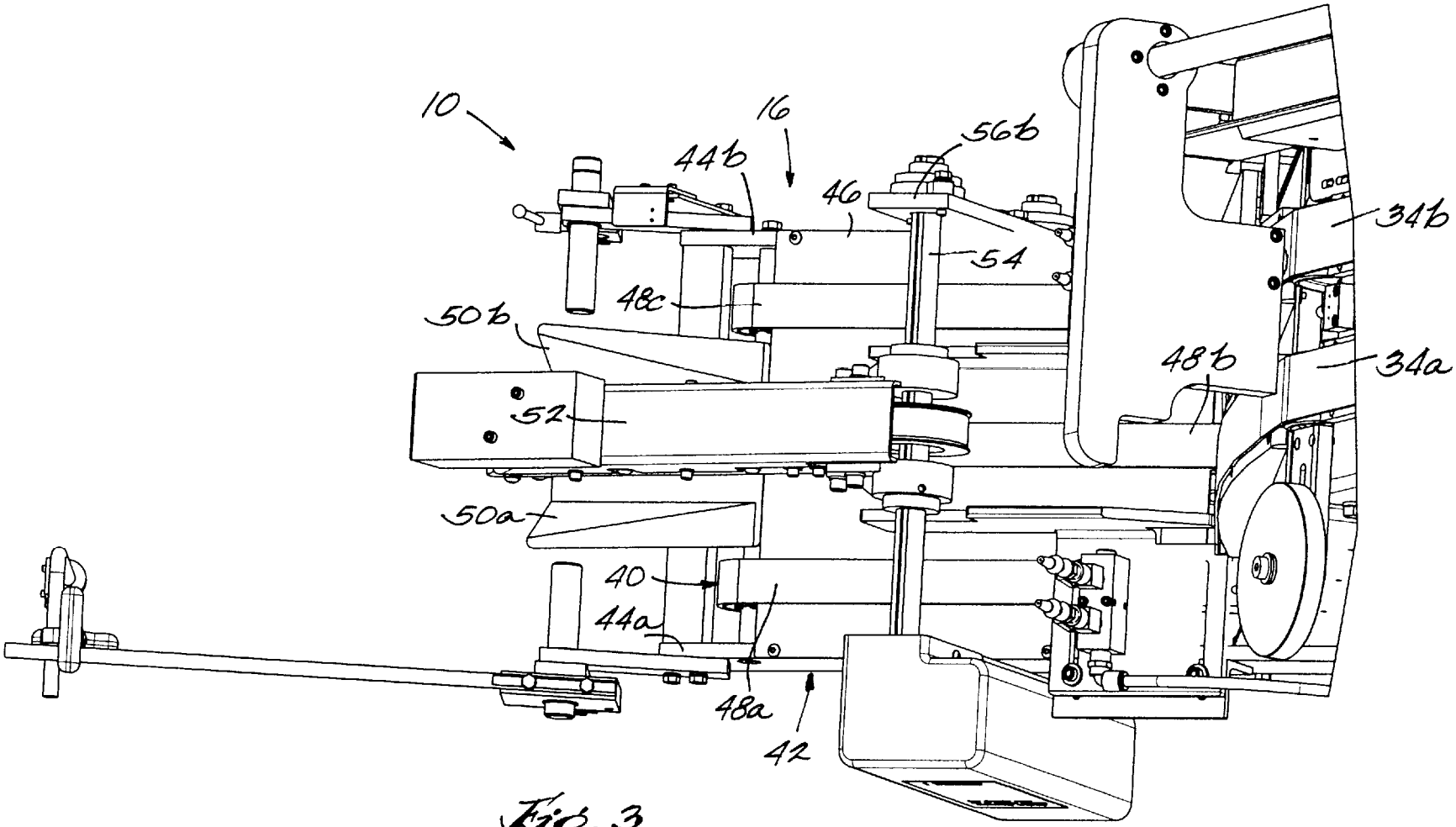
FIG. 3 is a perspective view from above the signature hopper loader of FIG. 1.
Figure 4:
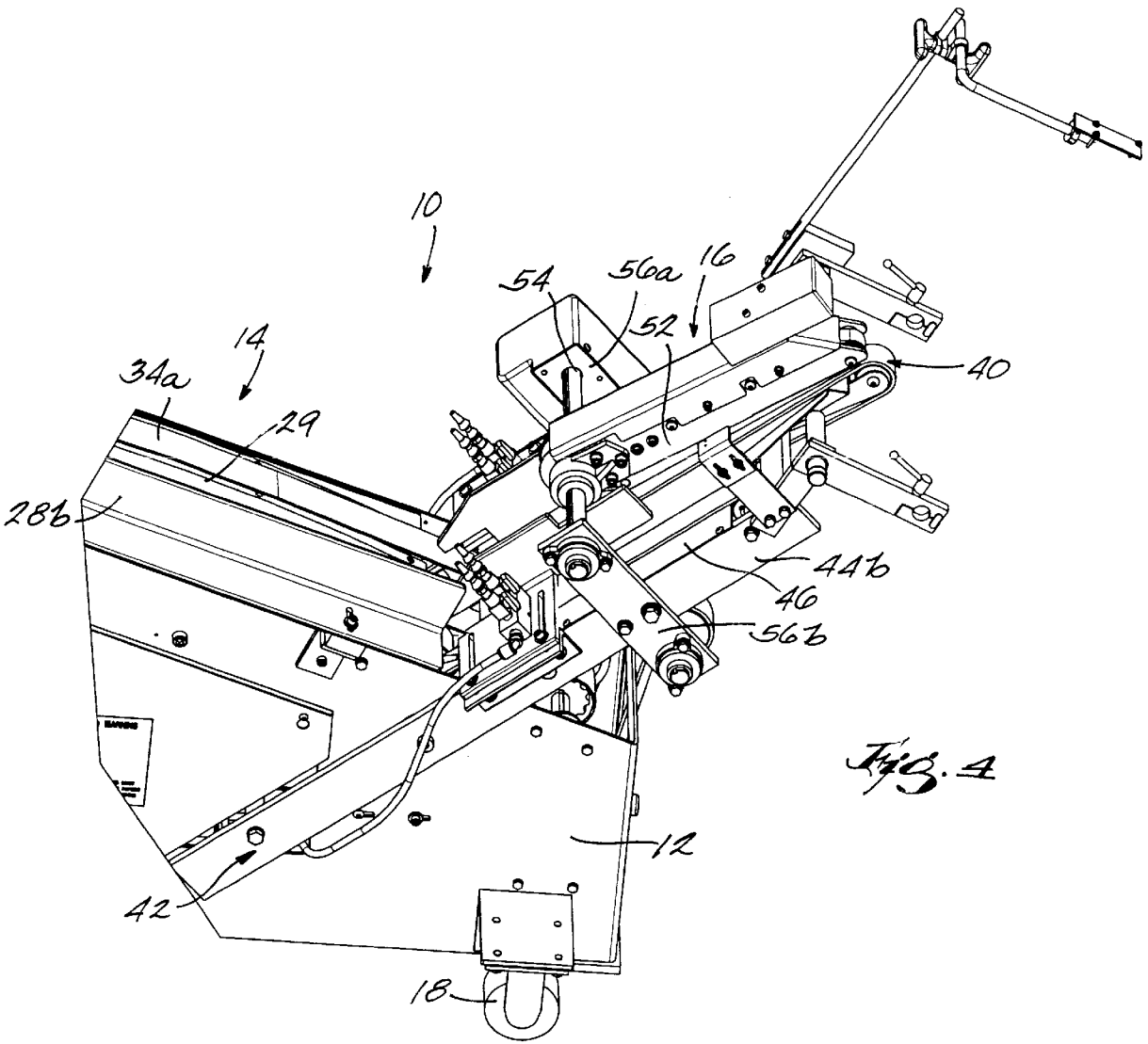
FIG. 4 is a perspective view from the side of the signature hopper loader of FIG. 1 illustrating an opposed guide positioned against the second conveyor.

Referring to FIGS. 2 and 3, the second conveyor assembly 16 includes a set of forming guides 50*a–b* that serve to bend the signatures as the signatures move along the travel path of the second conveyor assembly 16. The configuration of the forming guides 50*a–b* bends the signatures into a V-type configuration which gives the signatures rigidity and facilitates deblocking of the signatures. Increasing the rigidity of the signatures prevents the signatures from becoming misaligned as they are transported from the second conveyor assembly 16. Deblocking the signatures while they are traveling in a shingled stream on the second conveyor assembly 16 also enhances the reliability associated with supplying individual signatures from the second conveyor assembly.

One of the forming guides 50*a* is positioned between the belts 48*a–b* and the other forming guide 50*b* is positioned between the belts 48*b–c*. Each of the forming guides 50*a–b* is positioned at an acute angle relative to the travel path of the belts 48*b–c* on second conveyor assembly 16. It should be understood that (i) there could be additional sets of forming guides; (ii) there may be only one forming guide; (iii) one or more of the forming guides may be positioned on an opposite side of the plane of the travel path; and (iv) the forming guides may be along the first conveyor assembly without departing from the scope of the present invention.

Figure 5:
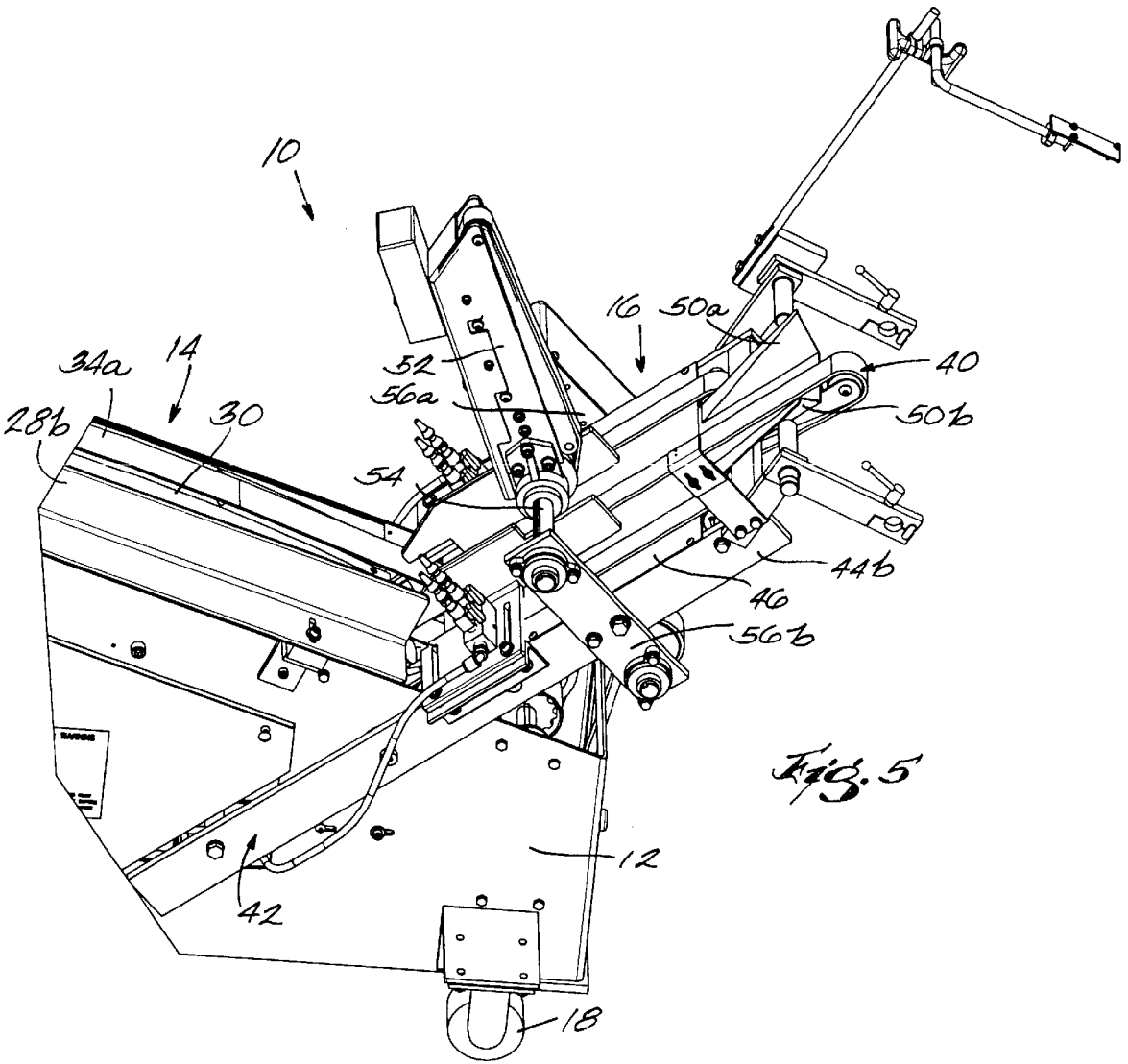
FIG. 5 is a perspective view similar to FIG. 4 illustrating the opposed guide rotated away from the second conveyor.
Figure 6:
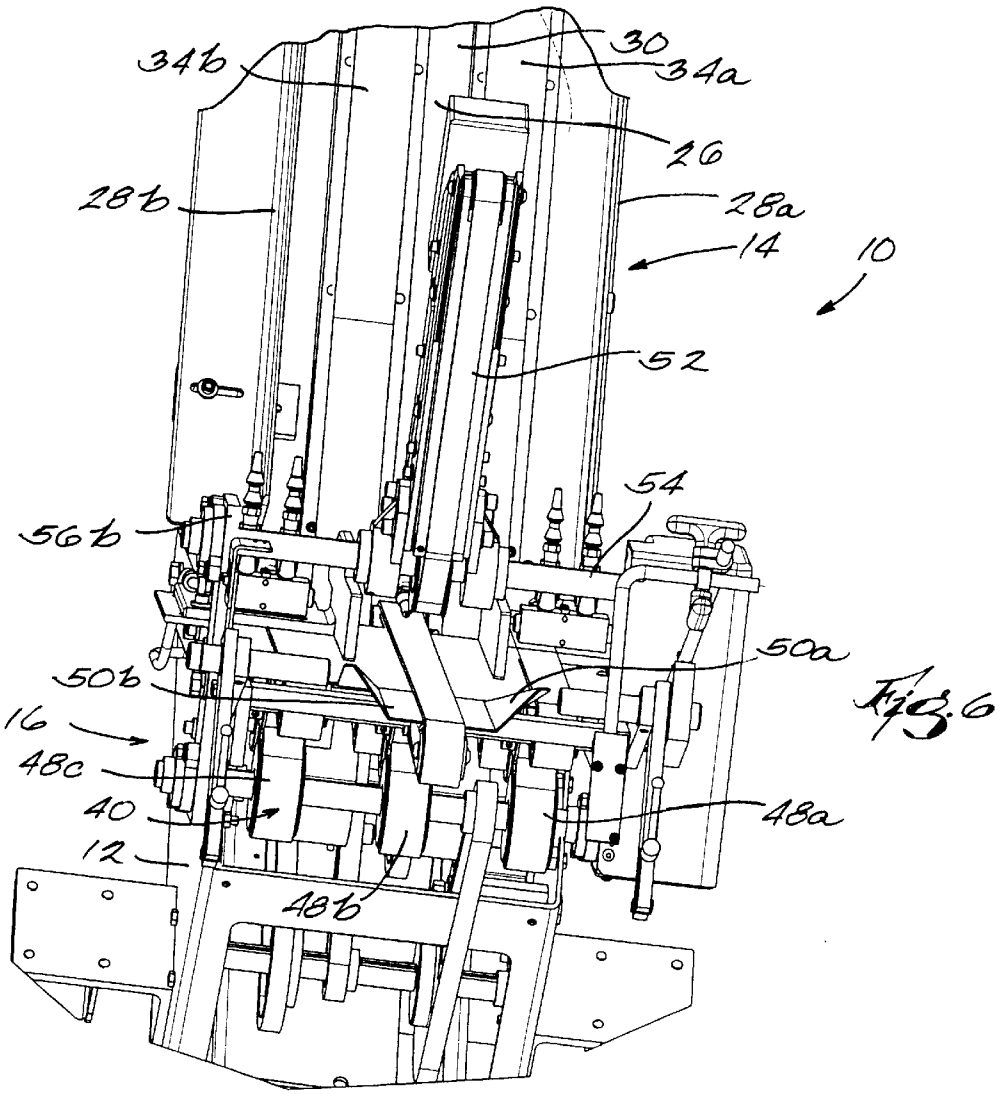
FIG. 6 is a perspective view from above one end of the hopper loader of FIG. 5 illustrating the opposed guide rotated away from the second conveyor.

The hopper loader 10 includes a guide belt 52 that is positioned against the belt 48*b* on the second conveyor assembly 16 such that the shingled stream of signatures moves between the endless belt 48*b* and the guide belt 52 and passes over the forming guides 50*a–b*. The guide belt 52 is rotatably mounted to a shaft 54 such that the guide belt 52 is maneuverable between a first position where the guide belt 52 is held against the belt 48*b* by gravity (FIGS. 1–4), and a second position where the guide belt 52 is disengaged from the belt 48*b* (FIGS. 5 and 6). It should be noted that the drive belt may be passive (i.e., not driven), driven independently, or driven in conjunction with other drives on the hopper loader 10. The shaft 54 that supports the guide belt 52 is mounted at opposing ends to lateral members 56*a–b* which are secured to the lateral supports 44*a–b* on the frame 42.

Figure 7:
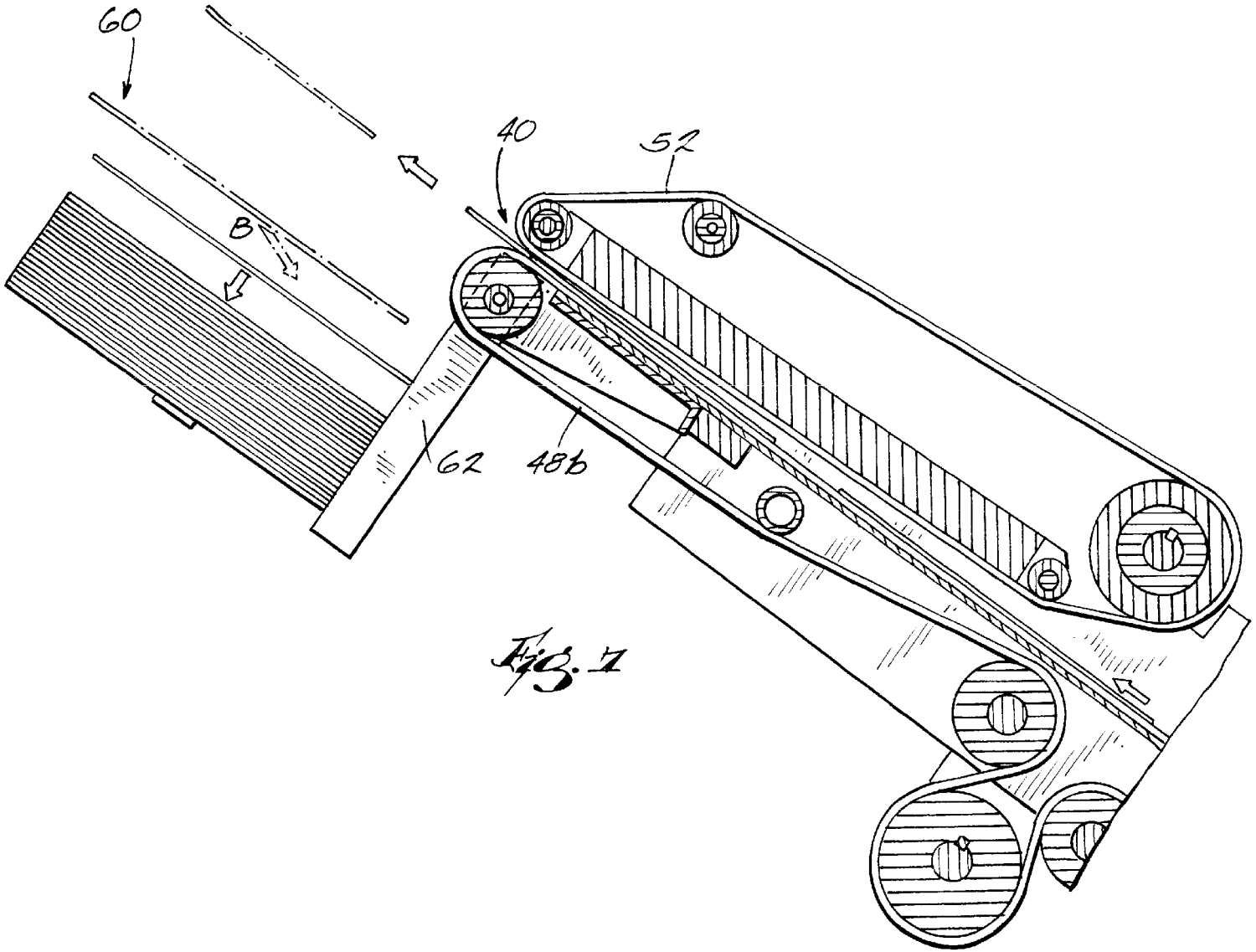
FIG. 7 is an enlarged partial section view of a pocket that is connected to an end of the second conveyor assembly on the hopper loader of the present invention.

Referring to FIG. 7, as the signatures pass from between the guide belt 52 and the conveyor belt 48*b* the signatures are delivered to a pocket 60 that holds a supply of signatures which are subsequently delivered to a binding line. The pocket 60 includes a feed rack 62 that supports an edge of the signatures while they are stored within the pocket 60. The feed rack 62 is positioned such that the signatures do not substantially change orientation as they are delivered from the second conveyor assembly 16 to the pocket 60. Maintaining the orientation of the signatures as they are placed onto the feed rack 62 inhibits newly delivered signatures from pushing against previously loaded signatures on the feed rack 62 and causing misalignment of the signatures while they are stored on the feed rack 62. The orientation of the signatures is maintained because the feed rack 62 is positioned perpendicular to the travel path of the signatures at the end of the second conveyor assembly 16.

The pocket 60 is also positioned such that there is a drop between the second end 40 of the second conveyor assembly 16 and the feed rack 62. As the signatures are transported from between the guide belt 52 and the belt 48*b*, the signatures fall downward (indicated by arrow B) to the feed rack 62 such that the impact generated by the signatures falling against the feed rack 62 facilitates placing the bottom of each of the signatures squarely against the feed rack 62. Positioning the signatures squarely against the feed rack 62 facilitates feeding individual signatures from the pocket 60 onto a binding line.

Various other features and advantages of the invention are set forth in the following claims.

What is claimed is:

1. A hopper loader for feeding signatures to a hopper on a binding line, the hopper loader comprising:

a first conveyor assembly including a first conveyor for moving the signatures toward the hopper, and a second conveyor assembly connected to the first conveyor assembly, the second conveyor assembly including a second conveyor for receiving the signatures from the first conveyor and moving the signatures to the hopper, the second conveyor being positioned such that there is an angle in the range of 110–120 degrees between the first conveyor and the second conveyor.

2. The hopper loader of claim 1 wherein the angle between the first conveyor and the second conveyor is in the range of 114–116 degrees.

3. A hopper loader comprising:

a first conveyor for moving signatures toward a hopper along a travel path;

a second conveyor adjacent to the first conveyor for receiving the signatures from the first conveyor and moving the signatures to the hopper along the travel path; and a forming guide near one of the first and second conveyors, the forming guide having a ramp portion that is at an acute angle relative to a plane of the travel path for bending a lateral edge of the signatures as the signatures move along the travel path.

4. A hopper loader as recited in claim 3 wherein the forming guide is positioned near the second conveyor.

5. A hopper loader as recited in claim 4 wherein the forming guide is attached to the second conveyor.

6. A hopper loader as recited in claim 4 wherein the ramp portion defines a guide plane such that the angle between the guide plane and the plane of the travel path of the second conveyor is in the range of about 5 degrees to about 60 degrees.

7. A hopper loader as recited in claim 1 wherein the second conveyor includes a plurality of endless belts extending along the travel path and the forming guide is positioned between a pair of the plurality of belts.

8. A hopper loader as recited in claim 7 wherein the second conveyor includes three endless belts such that there is a middle belt and two outside belts.

9. A hopper loader as recited in claim 1 wherein the forming guide is positioned between the middle belt and one of the outside belts.

10. A hopper loader as recited in claim 9 wherein the forming guide is positioned in a plane that is at an acute angle relative to the travel path of one of the outside belts.

11. A hopper loader as recited in claim 8 further comprising a second forming guide positioned between the middle belt and the other of the outside belts.

12. A hopper loader as recited in claim 11 wherein the second forming guide is positioned in a plane that is at an acute angle relative to the plane of travel path of the other outside belt.

13. The hopper loader of claim 12 wherein the forming guides are positioned adjacent to one another to form a set of forming guides that form the signatures into a V-shape as the signatures are transported over the set of forming guides.

14. The hopper loader of claim 3 wherein the forming guide narrows as the forming guides extends away from the travel path.

15. A hopper loader comprising:

a first conveyor for supporting and moving signatures toward a hopper along a travel path;

a second conveyor adjacent to the first conveyor for receiving the signatures from the first conveyor and moving the signatures toward the hopper along the travel path;

a first forming guide near the second conveyor, the first forming guide being positioned in a plane that is at a first acute angle relative to the travel path for bending the signatures as the signatures move along the travel path; and a second forming guide adjacent to the first forming guide, the second forming guide being positioned in a plane that is at a second acute angle relative to the travel path for bending the signatures as the signatures move along the travel path, wherein the first and second forming guides are positioned such that the signatures travel between them in a non-planar orientation.

16. A hopper loader of claim 15 wherein the first forming guide and the second forming guide are attached to the second conveyor.

17. The hopper loader of claim 16 wherein the first acute angle is in a range of about 5degrees to about 60 degrees, and the second acute angle is in a range of about 5degrees to about 60 degrees.

18. The hopper loader of claim 16 wherein the angle between the second forming guide and the plane of the travel path of the second conveyor is substantially the same as the angle between the first forming guide and the plane of the travel path of the second conveyor.

19. The hopper loader of claim 16 wherein the first forming guide and the second forming guide are on the same side of plane of the travel path.

20. A hopper loader as recited in claim 16 wherein the second conveyor includes three endless belts such that there is a middle belt and two outside belts.

21. A hopper loader as recited in claim 20 wherein the first forming guide is positioned between the middle belt and one of the outside belts and the second forming guide is positioned between the middle belt and the other of the outside belts.

22. A hopper loader as recited in claim 20 wherein the first forming guide is positioned in a plane that is at an acute angle relative to the travel path of one of the outside belts and the second forming guide is positioned in a plane that is at an acute angle relative to the travel path of the other outside belt.

23. The hopper loader of claim 22 wherein the first and second forming guides form a set of forming guides that bend the signatures into a V-shape as the signatures are transported over the second conveyor.

24. A hopper loader comprising:

a first conveyor for moving signatures toward a hopper;

a second conveyor adjacent to the first conveyor, the second conveyor positioned on an incline for receiving the signatures from the first conveyor and moving the signatures toward the hopper, wherein the signatures are in a shingled stream on the second conveyor; and a guide belt positioned such that the shingled stream of signatures moves between the second conveyor and the guide belt.

25. The hopper loader of claim 24 wherein the guide belt is rotatably mounted to the second conveyor.

26. The hopper loader of claim 24 wherein the guide belt is moveable between a first position where the guide belt engages the second conveyor and a second position where the guide belt is disengaged from the second conveyor.

27. The hopper loader of claim 24 wherein the guide belt is held against the second conveyor by gravity.

28. The hopper loader of claim 24 wherein the guide belt is driven separately from the first and second conveyor assemblies.

29. The hopper loader of claim 24 wherein the second conveyor includes a plurality of endless belts and the guide belt engages at least one of the plurality of endless belts that make up the second conveyor.

30. The hopper loader of claim 29 wherein the second conveyor includes three parallel endless belts such that there is a middle belt and two outside belts.

31. The hopper loader of claim 30 wherein the guide belt engages the middle belt.

32. A hopper loader comprising:

a first conveyor for moving signatures toward a hopper;

a second conveyor adjacent to the first conveyor for receiving the signatures from the first conveyor and moving the signatures in a shingled stream toward the hopper; and a feed rack connected to the second conveyor, the feed rack positioned in a non-horizonatal plane at an end of the second conveyor for receiving the signatures from the second conveyor such that the signatures are placed onto the feed rack without any substantial change in orientation.

33. The hopper loader of claim 32 wherein the second conveyor includes a travel path that is substantially planar.

34. The hopper loader of claim 32 wherein there is an angle in the range of 110–120 degrees between the first conveyor and the second conveyor.

35. A hopper loader comprising:

a first conveyor for moving signatures toward a hopper;

a second conveyor adjacent to the first conveyor for receiving the signatures from the first conveyor and moving the signatures in a shingled stream toward the hopper; and a feed rack that is below the travel path at an end of the second conveyor, the feed rack adapted to receive the signatures from the second conveyor such that the signatures fall in a non-horizontal plane onto the feed rack.

36. The hopper loader of claim 35 wherein the travel path of the second conveyor is substantially planar.

37. The hopper loader of claim 35 wherein the feed rack is substantially planar.

38. The hopper loader of claim 35 wherein there is an angle in the range of 110–120 degrees between the first conveyor and the second conveyor.

39. A hopper loader comprising:

a first conveyor;

a second conveyor adjacent to the first conveyor, the second conveyor receiving the signatures from the first conveyor and moving the signatures to a hopper along a travel path; and a forming guide near one of the first and second conveyors, the forming guide being positioned in a guide plane that is at an acute angle relative to a plane of the travel path, a first portion of the signatures traveling in the guide plane for bending the first portion and a second portion of the signatures traveling in the travel plane as the signatures move along the travel path.

40. A hopper loader comprising:

a first conveyor;

a second conveyor adjacent to the first conveyor, the second conveyor adapted to receive the signatures from the first conveyor and move the signatures toward a hopper, wherein the signatures are in a shingled stream on the second conveyor; and a guide belt positioned such that the shingled stream of signatures moves between the second conveyor and the guide belt, the guide belt being independently driven with respect to the first and second conveyors.

41. A hopper loader comprising:

a first conveyor;

a second conveyor adjacent to the first conveyor, the second conveyor adapted to receive signatures from the first conveyor and move the signatures in a travel plane toward a hopper; and a feed rack connected to the second conveyor, the feed rack positioned below the travel plane, the feed rack oriented at an angle to the horizontal and adapted to receive the signatures such that the signatures are placed onto the feed rack in a planar orientation that is parallel with the travel plane.

* * * * *